US005845554A

United States Patent [19]

Kozyrski

[11] Patent Number: 5,845,554

[45] Date of Patent: Dec. 8, 1998

[54] SHEET MATERIAL CUTTING MACHINE

[75] Inventor: Vincent T. Kozyrski, Plainville, Conn.

[73] Assignee: The Fletcher-Terry Company, Farmington, Conn.

[21] Appl. No.: 789,822

[22] Filed: Jan. 28, 1997

Related U.S. Application Data

[63] Continuation of Ser. No. 434,270, May 3, 1995, abandoned.

[51] Int. Cl.[6] ..... B26D 7/02

[52] U.S. Cl. ..... 83/455; 83/485; 83/582; 83/614

[58] Field of Search ..... 83/614, 578, 455, 83/485, 582

[56] References Cited

U.S. PATENT DOCUMENTS

| | | | |
|---|---|---|---|
| 630,019 | 8/1899 | Worthen . | |
| 804,520 | 11/1905 | Colthar | 83/485 |
| 985,446 | 2/1911 | Pease | 83/487 |
| 992,755 | 5/1911 | Crocker . | |
| 1,053,359 | 2/1913 | Clark | 83/614 |
| 1,075,050 | 10/1913 | Mihills . | |
| 1,735,520 | 11/1929 | Williams | 83/485 |
| 2,327,223 | 8/1943 | Silver . | |
| 2,450,496 | 10/1948 | Whiteley . | |
| 2,753,938 | 7/1956 | Thiess . | |
| 3,110,210 | 11/1963 | Post . | |
| 3,447,409 | 6/1969 | Lewis | 83/614 |
| 3,532,018 | 10/1970 | Szabo | 83/614 |
| 3,540,337 | 11/1970 | Gardner . | |
| 3,821,915 | 7/1974 | Larrable . | |
| 3,918,337 | 11/1975 | Lindblad et al. . | |
| 4,152,962 | 5/1979 | Hendrischk . | |
| 4,442,744 | 4/1984 | Raymond . | |
| 4,516,452 | 5/1985 | Dahle . | |
| 4,686,876 | 8/1987 | Hume et al. . | |
| 4,754,674 | 7/1988 | Perlman | 83/614 |
| 4,867,023 | 9/1989 | Kozyrski et al. | 83/614 |
| 5,241,887 | 9/1993 | Wolff et al. . | |
| 5,307,716 | 5/1994 | Onishi et al. . | |
| 5,322,001 | 6/1994 | Boda . | |
| 5,524,515 | 6/1996 | Boda | 83/614 X |
| 5,582,053 | 12/1996 | Chubb et al. | 83/485 X |
| 5,611,253 | 3/1997 | Saito et al. | 83/614 X |

FOREIGN PATENT DOCUMENTS

| | | | |
|---|---|---|---|
| 1074958 | 10/1954 | France | 83/614 |
| 681908 | 9/1939 | Germany | 83/455 |
| 764876 | 9/1980 | U.S.S.R. | 83/455 |
| 1247681 | 9/1971 | United Kingdom | 83/455 |

*Primary Examiner*—M. Rachuba
*Assistant Examiner*—Charles Goodman
*Attorney, Agent, or Firm*—Ira S. Dorman

[57] ABSTRACT

A machine for manually cutting web material employs a cutting head that is supported on a rail for sliding and pivoting movement along and across a straight edge, which is disposed forwardly of the axis of pivoting. The cutting wheel is biased axially toward the straight edge, its axis being so disposed as to cause the biasing means to impart an upward force moment that tends to elevate the wheel blade. A guide plate is pivoted, by upward movement of the cutting head, so as to increase spacing from the surface of the base and thereby facilitate feeding of the workpiece.

4 Claims, 2 Drawing Sheets

SHEET MATERIAL CUTTING MACHINE

This application is a continuation of application Ser. No. 08/434,270, filed May 3, 1995, now abandoned.

BACKGROUND OF THE INVENTION

Numerous forms of apparatus are disclosed in the art, and are commercially available, for cutting and trimming web-like materials such as paper, cardboard, vinyl, photographic negative stock, and the like, supplied in either sheet or roll form. Such apparatus will typically employ a head or carriage that mounts a cutting wheel and is translated along a supporting board, shearing the workpiece in cooperation with a fixed straight-edge element. The following United States patents are representative of prior art that is directed to machines of that general character: Dahle U.S. Pat. No. 4,516,452; U.S. Pat. No. 4,686,876 to Hume et al; Onishi et al U.S. Pat. No. 5,307,716; and Boda U.S. Pat. No. 5,322,001.

To facilitate feeding of the material to the cutting location, it is common in such apparatus to mount the head, or clamping structure on which the head is supported, for pivotable displacement away from the path of workpiece movement; alternatively, elevating ramp structure may be provided for the same purpose at the opposite ends of the travel path. Pivotable mounting may however compromise precision by permitting deviation from the intended line of blade movement, and ramp structures require inconvenient and time-consuming movement of the carriage to the extremities of the travel path.

SUMMARY OF THE INVENTION

Accordingly, it is the broad object of the present invention to provide a web material cutting machine in which such difficulties and disadvantages of prior art apparatus are minimized or avoided.

More specific objects of the invention are to provide a cutting machine in which different thickness of the materials being cut do not produce deviations or loss of precision, which machine nevertheless enables facile feeding of the workpiece.

Related objects are to provide a machine having the foregoing features and advantages, which is also convenient to operate, and relatively uncomplicated and inexpensive to manufacture.

It has now been found that certain of the foregoing and related objects of the invention are attained by the provision of a machine for cutting sheet material (inclusive of web material in roll form, as well as individual sheets), which comprises a base having an upper surface portion, a cutting element affixed on the base contiguous to the surface portion and providing a rectilinear cutting edge therealong, a mounting rail having a rectilinear portion of uniform, effectively circular cross section, and means for supporting the rail over the base, substantially inwardly of the cutting edge and parallel to it. A cutting head has a rectilinear passage of effectively circular cross section, for slidable and pivotal movement on the rail portion, and it includes a cutting wheel and means for mounting the wheel for rotation about its axis and for operative disposition against the cutting edge. A blade element of the cutting wheel has an effectively flat inner surface portion, for sliding engagement with the cutting edge of the fixed cutting element; the mounting means mounts the wheel for axial displacement on its axis of rotation, and includes biasing means for urging the flat surface portion of the blade element into such engagement.

Because of the manner by which it is pivotally mounted, the head disposes the blade element for movement along an arc in which the cutting edge of the fixed element lies, taken with reference to the rail portion, and biasing of the wheel blade ensures that, if the edge of the fixed cutting element is flat, contact will be maintained with its apex, or upper corner.

In preferred embodiments, the axis of rotation of the cutting wheel will be disposed at a level between the upper surface portion of the base and the rail portion axis, so that reaction of the blade element against the straight edge, under the force of the biasing means, will urge pivoting of the head so as to move the blade element thereof upwardly. The upper surface portion of the machine base will normally be substantially planar, and the fixed cutting element will generally be provided by a metal straight-edge strip or piece, attached with an apex of its rectilinear cutting edge in the plane of the upper surface portion of the base.

The rail portion will usually be spaced above the base to enable facile passage thereunder of a sheet material workpiece, and the machine will most desirably include a plate for guiding the workpiece to the cutting location. Such a plate will normally extend along the rail portion, and will include an intermediate portion to which the rail is attached, a lead-in portion lying inwardly of the rail and spaced with a relatively wide gap from the surface portion of the base, and a holding portion lying outwardly of the rail and spaced with a relatively narrow gap from the base surface portion.

A contact element on the head will be disposed inwardly of the rail portion, in overlying relationship to the lead-in portion of the guide for engagement therewith when the head is so pivoted as to urge the blade upwardly of the cutting edge. This will in turn effect pivoting of the guide plate in the same direction about the rail portion, thus increasing the gap under the holding portion and thereby facilitating feeding of the workpiece material. By disposing the axis of rotation of the wheel at a level between the upper surface portion of the base and the rail portion axis, reaction of the blade element against the cutting edge, under the force of the biasing means, will urge upward pivoting of the head. A clamping plate will advantageously extend from the holding portion of the guide plate to the cutting edge of the fixed cutting element. The cutting wheel will, in such instances, normally include a pressure element that is disposed for rolling engagement on the clamping plate, to urge it toward the fixed cutting element when downward force is applied to the head.

DETAILED DESCRIPTION OF THE ILLUSTRATED EMBODIMENT

Figure 1:
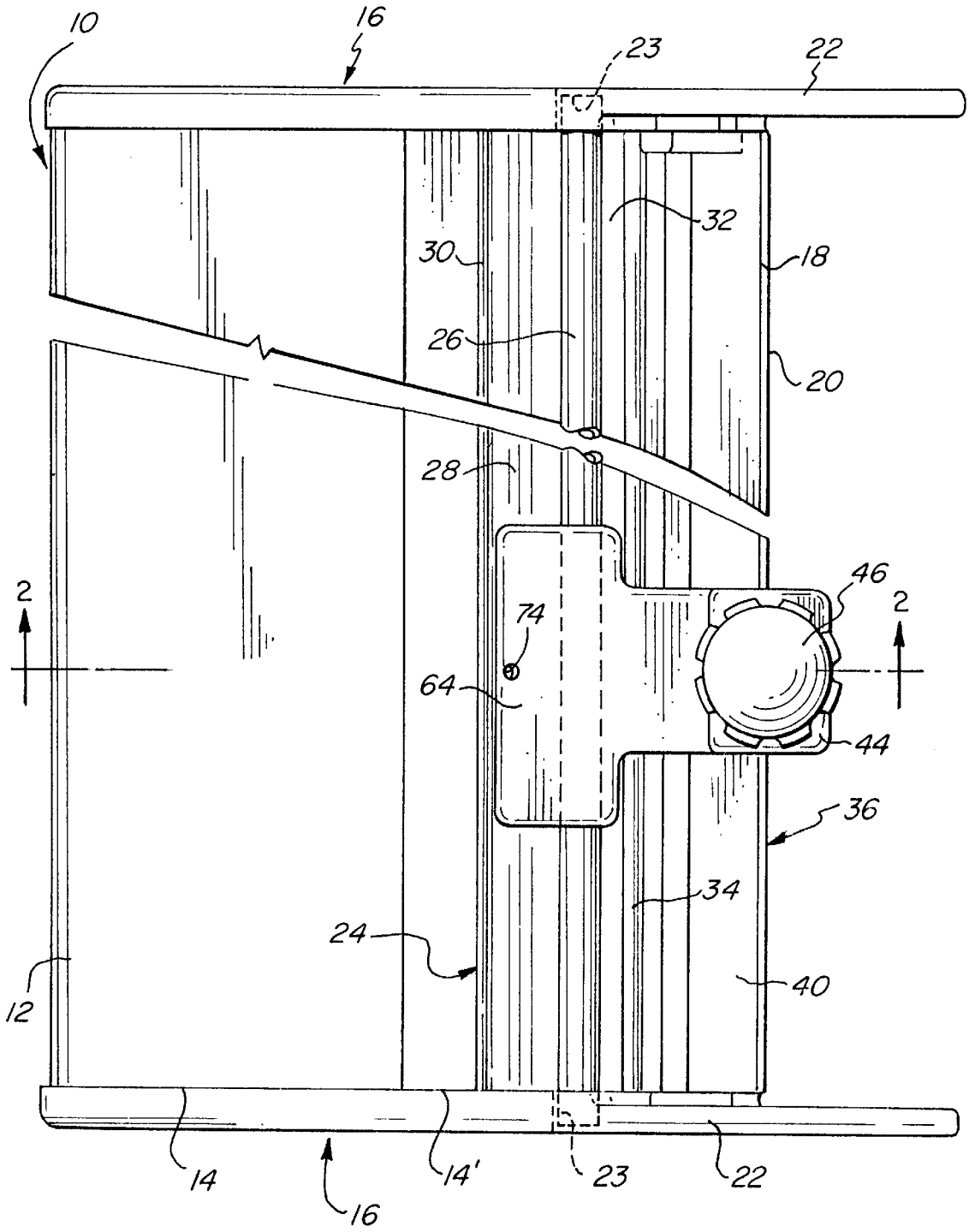
FIG. 1 is a fragmentary plan view of a machine embodying the present invention.

Turning now in detail to the appended drawings, therein illustrated is a cutting machine embodying the present invention and including a base, generally designated by the numeral 10. The base has an upper surface 12, and is comprised of a pair of panels in 14,14', assembled in side-by-side relationship by appropriate means (unnumbered); as will be appreciated, additional panels may be added to provide a base of greater width, if so desired. A stainless steel straight-edge element or strip 18 is secured along the forward (i.e., outward) margin of the panel 14' to provide a fixed cutting element with a flat edge 20 having an apex that lies flush with the upper surface 12 of the base 10 (as will be described more fully below). A bracket, generally designated by the numeral 16, is attached at each of the opposite ends of the base 10; the brackets have return portions 22, which extend over the base to points inwardly (i.e., rearwardly) of the cutting element 18, and each has a socket 23 formed into its free upper, inward end portion.

A guide plate, generally designated by the numeral 24, is formed as a metal (e.g., aluminum) extrusion and includes a rail component 26; the rail component is of substantially circular cross section, and it extends rectilinearly along the entire length of the plate 24 with its opposite ends pivotably seated in the sockets 23 of the brackets 16. The plate 24 includes a lead-in section 28, commencing in an upturned lip 30, and a holding section 32, which sections extend in opposite directions (i.e., inwardly, or rearwardly, and outwardly, or forwardly, respectively) from the rail component 26. The holding section 32 lies closer to the upper surface 12 of the base 10 than does the lead-in portion 28, which converges toward surface 12 in the outward direction. A curved lip element 34 extends lengthwise along the upper surface of the guide plate 24 and defines a slot 35 within which is engaged a lengthwise bead 38 on the inner edge of a clamping plate, generally designated by the numeral 36 and normally of molded plastic construction. The outermost portion 40 of the clamping plate 36 overlies closely and directly the metal straight-edge strip 18. A slot (unnumbered) extends along the lower surface of the portion 40, and seats a solid rubber tubular element 41 for enhanced holding power against the underlying web.

A cutting head, or carrier, comprises a body, generally designated by the numeral 42, with a forward portion 44 on which is mounted an operating knob 46. A downwardly opening cavity 48 is formed within the forward portion of the head 42, and serves to seat a wheel assembly, comprised of a metal cutting blade 50 and a pressure roller 52 fabricated from (or having a tire thereon fabricated from) a resilient plastic or rubber material. The wheel assembly is slidably and rotatably supported on a shaft 54, which extends through the forward wall 56 and the rearward wall 58 defining the cavity 48; the shaft also supports a coil spring 60, the rearward end portion of which surrounds a hub element 62 of the wheel assembly. As will be appreciated, the spring 60 urges the flat inner face 61 of the cutting wheel blade 50 against the flat edge 20 of the cutting strip 18, to produce a cooperative shearing action for severing of material delivered thereto.

The rearward portion 64 of the cutting head has a rectilinear, downwardly opening channel 66 extending endwise therethrough, in which is seated an annular bushing 68 of low-friction synthetic resinous material; the circular inner surface of the bushing engages the rail component 26 of the guide plate 24, and is split along its lower side to permit passage of the connecting element 27. A threaded aperture 70 is formed adjacent the rearmost edge of the body 42 and receives a nylon-tipped set screw 72, the screw being advanced sufficiently to protrude from the body and engage the upper surface of the clamping plate 24.

It will be self evident that the machine of the invention is employed by feeding the web material to be cut from the inboard side, through the tapered throat defined by the lead-in section 28 of the guide plate, under the holding section 32 thereof and ultimately to a position between the forward portion 40 of the clamping plate 36 and the fixed cutting element 18. Translating the cutting head in either direction along the rail component 26 will of course cause the cutting wheel blade 50 to sever material lying outwardly of the edge 20, under downward pressure applied to the head. This will also cause the pressure wheel 52 to bear upon the upper surface of the clamping plate portion 40, simultaneously holding the workpiece firmly against the cutting element 18 and supplying driving force for rotation of the blade element 50.

Figure 2:
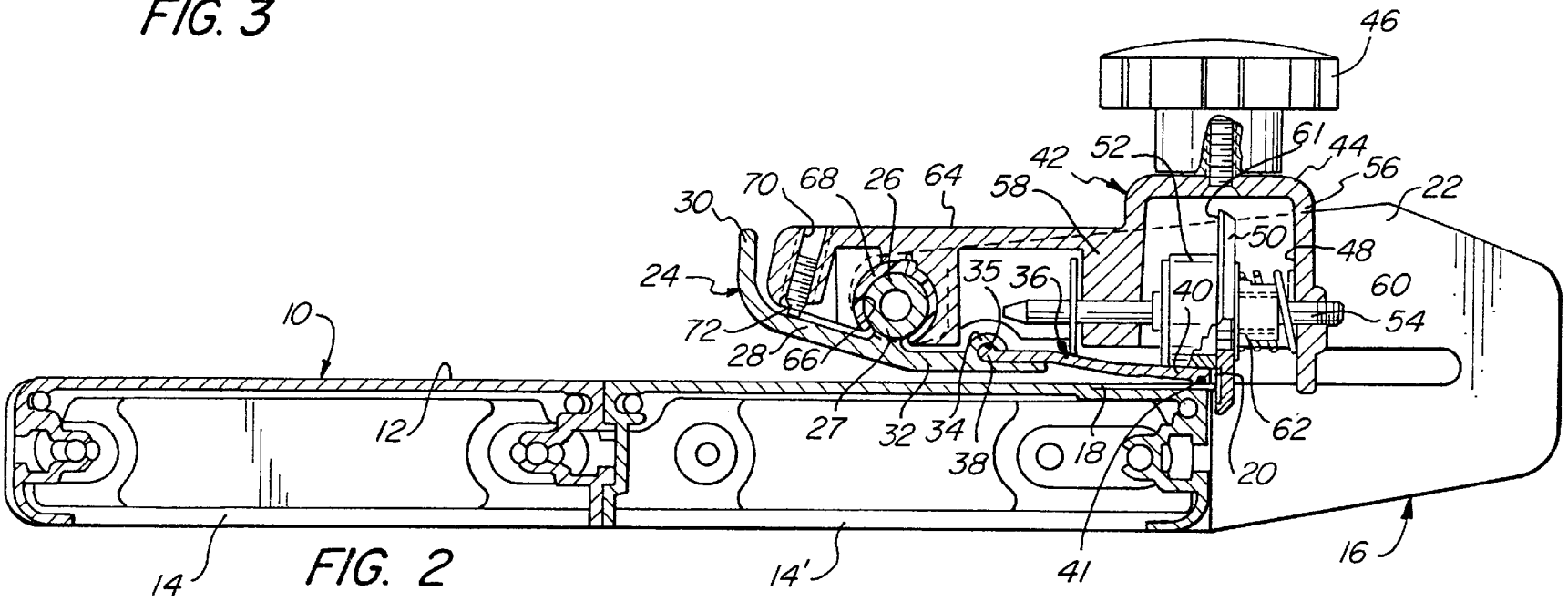
FIG. 2 is a side elevational view, in partial section, taken along line 2—2 of FIG. 1 and drawn to an enlarged scale.

Upon release of downward force, the head will pivot so as to cause the blade element 50 to shift upwardly relative to the cutting edge 20 (i.e., in a counterclockwise direction about the rail component 26, as viewed in FIG. 2). This results from the relationship that exists between the center line of the shaft 54, on which the spring 60 acts, and the axis of the rail component 26, which is offset slightly above the shaft center line. Thus, the biasing force of the spring 60, reacting through contact of the blade element 50 on the edge 20 of the strip 18, produces an upward moment. The resultant small degree of pivoting of the head (e.g., 2° to 5°) is transferred to the guide plate 24, unified therewith through contact by the set screw 72; this in turn causes the plate 24 to pivot in the same direction, thus lifting the clamping plate 36 slightly and permitting ready repositioning of the workpiece. A supplemental spring may be utilized in longer models of the machine, to assist elevation of its relatively heavy parts while avoiding the excessive drag that would be generated between the cutting wheel and the fixed blade if a heavier spring were employed on the wheel shaft 54; in shorter models, however, the unaided spring 60 will itself provide sufficient lifting force to maintain the open position of the clamping plate.

Figure 4B:
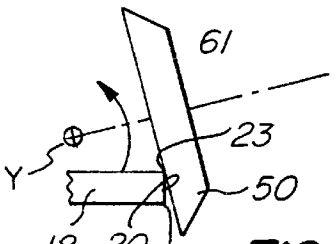
FIGS. 4A and 4B are diagrammatic representations of relationships that may exist between the cutting wheel blade and the fixed blade when prior art apparatus, and the instant machine, respectively, are employed for cutting relatively thick webs.
Figure 4A:
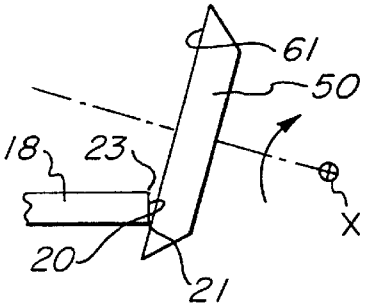
FIG. 4A (PRIOR ART)
Figure 3:
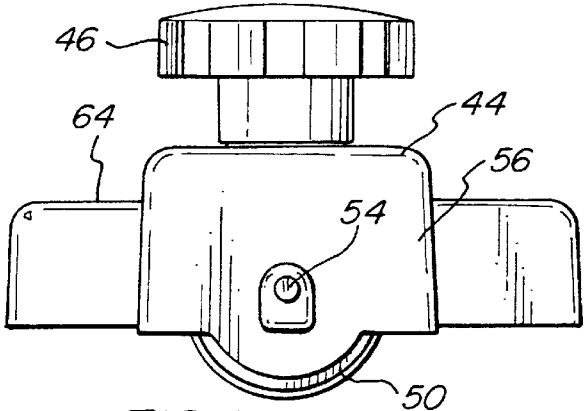
FIG. 3 is a front view of the cutting head utilized in the machine depicted in the foregoing Figures.

FIGS. 4A and 4B illustrate a fundamental advantage afforded by the machine of the present invention. FIG. 4A depicts a functional characteristic of a similar prior art machine, wherein the cutting wheel blade 50 is pivoted on an axis "X" that is disposed outwardly of the fixed element 18. As a result, when the blade 50 encounters a material that is relatively thick, or a multiple layer workpiece, and is forced thereby to pivot in the upward direction, the inner surface 61 of the wheel blade 50 comes to bear upon the lower corner 21 of the fixed element flat edge 20. This produces a significant gap between the wheel blade and the upper corner 23, and causes the line of severance to deviate from that which is measured and/or intended; the problem is exacerbated in cases in which materials of substantially different thicknesses are cut side-by-side, with a single stroke.

In contrast, the head of the instant machine pivots about the inboard axis "Y", thereby maintaining the inner surface 61 of the blade 50 in constant contact with the upper corner 23, or apex, of the edge 20. This results in a high degree of uniformity and precision in the line of severance produced.

Thus, it can be seen that the present invention provides a sheet material cutting machine in which the difficulties and disadvantages of comparable prior art apparatus, hereinabove described, are minimized or avoided. Variations in the thickness of the material being cut do not produce substantial cutting deviations or loss of precision. Moreover, the machine enables facile feeding of the workpiece, it is convenient to operate, normally by manual means, and it is relatively uncomplicated and inexpensive to manufacture.

Having thus described the invention, what is claimed is:

1. A machine for cutting sheet material, comprising: a base having an upper surface portion bounded by a forward margin, a rearward margin, and opposite end margins; an elongate cutting element disposed on said base along said forward margin contiguous to said surface portion and with said surface portion extending rearwardly therefrom, said cutting element providing a rectilinear cutting edge along, and spaced forwardly from, said surface portion; a mounting rail having an elongate, rectilinear portion of uniform, effectively circular cross section along the length of said rectilinear portion, said rectilinear portion of said mounting rail extending along a longitudinal axis; means for supporting said rail portion over said surface portion of said base, substantially rearwardly of said cutting edge with said longitudinal axis of said rail portion parallel to said cutting edge; a cutting head having structure defining a rectilinear passage, of effectively circular cross section, in which said rail portion is received for slidable movement of said head along said rail portion, and for pivotal movement of said head on said longitudinal axis, said head also including a cutting wheel having an axis of rotation, and mounting means for mounting said wheel for rotation about said axis of rotation, and for axial displacement of said wheel on said axis of rotation for disposition against said cutting edge to enable cutting, in cooperation therewith, as said head is moved along said rail portion on said longitudinal axis, said mounting means including a shaft disposed on said axis of rotation and supporting said cutting wheel for said rotation and said axial displacement of said cutting wheel, said axis of rotation of said cutting wheel being disposed at a level between said upper surface portion of said base and said rail portion longitudinal axis, and said cutting wheel having a blade element with an effectively flat surface portion disposed for sliding engagement with said cutting edge of said cutting element, said mounting means further including biasing means for urging said axial displacement of said cutting wheel, so as to in turn urge said flat surface portion of said blade element into engagement with said cutting edge, said head disposing said blade element for movement upwardly, away from said cutting edge, along an arc in which said cutting edge lies, taken with reference to, and upon pivoting of said head about, said rail portion, said means for supporting disposing said rail portion in spaced relationship to said upper surface portion, to enable passage under said rail portion of a sheet material workpiece supported upon said surface portion; and a guide plate for guiding feeding of the workpiece under said rail portion and to said cutting edge, said guide plate extending along said rail portion and including an intermediate portion to which said rail portion is attached, a lead-in portion spaced in said rearward direction from said rail portion and spaced with a relatively wide gap from said surface portion of said base, and a holding portion lying forwardly of said intermediate portion and spaced with a relatively narrow gap from said base surface portion; said cutting head further including a contacting element spaced from said rail portion in said rearward direction and disposed in overlying relationship to said lead-in-portion of said guide plate, for contact therewith by pivoting of said head about said rail portion so as to urge said blade element upwardly of said cutting edge, said contact between said contacting element and said lead-in portion of said guide plate effecting pivoting of said guide plate about said rail portion to thereby increase the gap between said holding portion of said guide plate and said surface portion of said base and thus facilitate feeding of the workpiece under said rail portion to said cutting edge, reaction of said blade element against said cutting edge, under the force of said biasing means, urging pivoting of said head to effect upward movement of said blade element.

2. The machine of claim 1 further including a clamping plate attached to said holding portion of said guide plate and extending therefrom at least substantially to said cutting edge in overlying relationship to, and along substantially the entire length of, said cutting element; and wherein said cutting wheel includes a pressure wheel element disposed for rolling engagement upon said clamping plate to urge said clamping plate toward said cutting element when force is applied to urge pivoting of said head to effect downward movement of said blade element.

3. A machine for cutting sheet material, comprising: a base having an upper surface portion bounded by a forward margin, a rearward margin, and opposite end margins; an elongate cutting element disposed on said base along said forward margin contiguous to said surface portion and with said surface portion extending rearwardly therefrom, said cutting element providing a rectilinear cutting edge along, and spaced forwardly from, said surface portion; a mounting rail having an elongate, rectilinear portion of uniform, effectively circular cross section along the length of said rectilinear portion, said rectilinear portion of said mounting rail extending along a longitudinal axis; means for supporting said rail portion over said surface portion of said base, substantially rearwardly of said cutting edge with said longitudinal axis of said rail portion parallel to said cutting edge; a cutting head having structure defining a rectilinear passage, of effectively circular cross section, in which said rail portion is received for slidable movement of said head along said rail portion on said longitudinal axis, and for pivotal movement of said head on said longitudinal axis, said head also including a cutting wheel having an axis of rotation, and mounting means for mounting said wheel for rotation about said axis of rotation, and for axial displacement of said wheel on said axis of rotation for disposition against said cutting edge to enable cutting, in cooperation therewith, as said head is moved along said rail portion on said longitudinal axis, said mounting means including a shaft disposed on said axis of rotation and supporting said cutting wheel for said rotation and said axial displacement of said cutting wheel, said axis of rotation of said cutting wheel being disposed at a level between said upper surface portion of said base and said rail portion longitudinal axis, and said cutting wheel having a blade element with an effectively flat surface portion disposed for sliding engagement with said cutting edge of said cutting element, said mounting means further including biasing means for urging said axial displacement of said cutting wheel, so as to in turn urge said flat surface portion of said blade element into engagement with said cutting edge, said head disposing said blade element for movement upwardly, away from said cutting edge, along an arc in which said cutting edge lies, taken with reference to, and upon pivoting of said head about, said rail portion, reaction of said blade element against said cutting edge, under the force of said biasing means, urging pivoting of said head to effect upward movement of said blade element, said means for supporting disposing said rail portion in spaced relationship to said upper surface portion, to enable passage under said rail portion of a sheet material workpiece supported upon said surface portion; and a guide plate for guiding feeding of the workpiece under said rail portion and to said cutting edge, said guide plate extending along said rail portion and including an intermediate portion to which said rail portion is attached, a lead-in portion spaced in said rearward direction from said rail portion and spaced with a relatively wide gap from said surface portion of said base, and a holding portion lying forwardly of said intermediate portion and spaced with a relatively narrow gap from said base surface portion; said cutting head further including a contacting element spaced from said rail portion in said rearward direction and disposed in overlying relationship to said lead-in portion of said guide plate, for contact therewith by pivoting of said head about said rail portion so as to urge said blade element upwardly of said cutting edge, said contact between said contacting element and said lead-in portion of said guide plate effecting pivoting of said guide plate about said rail portion to thereby increase the gap between said holding portion of said guide plate and said surface portion of said base, and thus facilitate feeding of the workpiece.

4. The machine of claim 3 further including a clamping plate attached to said holding portion of said guide plate and extending therefrom at least substantially to said cutting edge in overlying relationship to, and along substantially the entire length of, said affixed cutting element; and wherein said cutting wheel includes a pressure wheel element disposed for rolling engagement upon said clamping plate to urge said clamping plate toward said affixed cutting element when force is applied to urge pivoting of said head in the direction opposite to said angular direction.

* * * * *